US011179684B2

(12) United States Patent
Zhang et al.

(10) Patent No.: US 11,179,684 B2
(45) Date of Patent: Nov. 23, 2021

(54) SYSTEM, DEVICE, AND METHOD TO MANUFACTURE NANOBUBBLES

(71) Applicant: New Jersey Institute of Technology, Newark, NJ (US)

(72) Inventors: Wen Zhang, Livingston, NJ (US); Taha Marhaba, Newark, NJ (US); Ahmed Khaled Abdella Ahmed, Newark, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 211 days.

(21) Appl. No.: 16/135,716

(22) Filed: Sep. 19, 2018

(65) Prior Publication Data

US 2019/0083945 A1 Mar. 21, 2019

Related U.S. Application Data

(60) Provisional application No. 62/560,948, filed on Sep. 20, 2017.

(51) Int. Cl.
*B01F 3/04* (2006.01)

(52) U.S. Cl.
CPC .. *B01F 3/04262* (2013.01); *B01F 2003/0439* (2013.01); *B01F 2003/04319* (2013.01);
(Continued)

(58) Field of Classification Search
CPC ..... B01F 3/04262; B01F 2003/04319; B01F 2003/0439; B01F 2215/0495;
(Continued)

(56) References Cited

U.S. PATENT DOCUMENTS 3,970,731 A * 7/1976 Oksman ..... B01F 3/04262 261/122.1
4,897,204 A * 1/1990 Katoh ..... B01F 3/0446 210/220

(Continued)

FOREIGN PATENT DOCUMENTS

GB 712325 * 8/1952

OTHER PUBLICATIONS

Zhang et al. "A facile method to prepare superhydrophobic coatings by calcium carbonate" Industrial & Engineering Chemistry Research 50, 3089-3094 published 2011 (Year: 2011).*

(Continued)

*Primary Examiner* — Stephen Hobson
(74) *Attorney, Agent, or Firm* — Lerner, David, Littenberg, Krumholz & Mentlik, LLP

(57) ABSTRACT

Systems, devices, and methods for manufacturing nanobubbles are disclosed herein. In an embodiment, a nanobubble generator system includes a medium, wherein in the medium is a liquid medium or a semi-liquid medium. A device is immersed in the medium. The device includes a ceramic membrane having a first surface and an opposing second surface, and pores extending through the membrane from the first surface to the second surface, and a hydrophobic porous coating layer disposed on the first surface of the membrane. The system includes a gas source for providing a gas to the medium. In operation, the gas enters pores on the second surface of the membrane and exits the coating layer in the form of nanobubbles.

11 Claims, 8 Drawing Sheets

(52) U.S. Cl.
CPC ..... *B01F 2003/04411* (2013.01); *B01F 2003/04858* (2013.01); *B01F 2215/0431* (2013.01); *B01F 2215/0495* (2013.01)

(58) Field of Classification Search
CPC .... B01F 2003/04858; B01F 2215/0431; B01F 2003/04411
See application file for complete search history.

(56) References Cited

U.S. PATENT DOCUMENTS 5,804,105 A * 9/1998 Allison ..... B26F 1/0015 261/122.2
8,794,604 B2 * 8/2014 Ryu ..... B01F 3/04262 261/122.1
8,919,747 B2 * 12/2014 Anzai ..... B01F 3/0451 261/117
9,385,391 B2 * 7/2016 Longman ..... H01M 8/188
9,539,550 B1 * 1/2017 Frankel ..... B01F 3/04262
10,591,231 B2 * 3/2020 Russell ..... C02F 1/685
10,624,841 B2 * 4/2020 Yaniv ..... A61K 9/0014
2013/0082410 A1 * 4/2013 Goodwin ..... C12M 23/14 261/42
2014/0191425 A1 * 7/2014 Yano ..... B01F 3/04113 261/124
2017/0259219 A1 * 9/2017 Russell ..... B01F 5/0465
2018/0008940 A1 * 1/2018 Ward ..... H01M 8/188
2019/0344224 A1 * 11/2019 Griffiths ..... B01F 3/04262
2019/0374910 A1 * 12/2019 Zhang ..... B01F 3/04262
2020/0398231 A1 * 12/2020 Nagata ..... B01F 3/04248
2021/0113976 A1 * 4/2021 Beery ..... B01F 7/10
2021/0146318 A1 * 5/2021 Horiuchi ..... B01F 5/0287

OTHER PUBLICATIONS

Calgaroto, et al., "On the Nanobubbles Interfacial Properties and Future Applications in Flotation", Minerals Engineering, vol. 60, Jun. 2014, pp. 33-40.
Hofmann, et al., "Role of Bubble Size for the Performance of Continuous Foam Fractionation in Stripping Mode", Colloids and Surfaces A: Physicochemical and Engineering Aspects, vol. 473, May 2015, pp. 85-94.
Li, et al., "Characteristics of Micro-Nano Bubbles and Potential Application in Groundwater Bioremediation", Water Environment Research, vol. 86, No. 9, Sep. 2014, pp. 844-851.
Oeffinger, et al., "Development and Characterization of a Nano-Scale Contrast Agent", Ultrasonics, vol. 42, No. 1-9, Apr. 2004, pp. 343-347.
Oshita, et al., "Nanobubble Characteristics and Its Application to Agriculture and Foods", InInternational Symposium on Agri-Foods for Health and Wealth, Aug. 2013, 10 pages.
Serizawa, et al., "Laminarization of Micro-Bubble Containing Milky Bubbly Flow in a Pipe", InThe 3rd European-Japanese Two-phase Flow Group Meeting, Certosa di Pontignano, Sep. 2003, 8 pages.
Siswanto, et al., "Investigation of Bubble Size Distributions in Oscillatory Fliow at Various Flow Rates", InThe University of Sheffield Engineering Symposium Conference Proceedings, vol. 1, Jun. 2014, 2 pages.
Ushikubo, et al., "Evidence of the Existence and the Stability of Nano-Bubbles in Water", Colloids and Surfaces A: Physicochemical and Engineering Aspects, vol. 361, No. 1-3, May 2010, pp. 31-37.

* cited by examiner

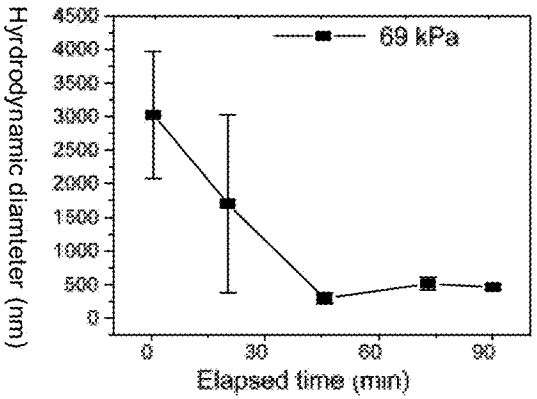
FIG. 5A
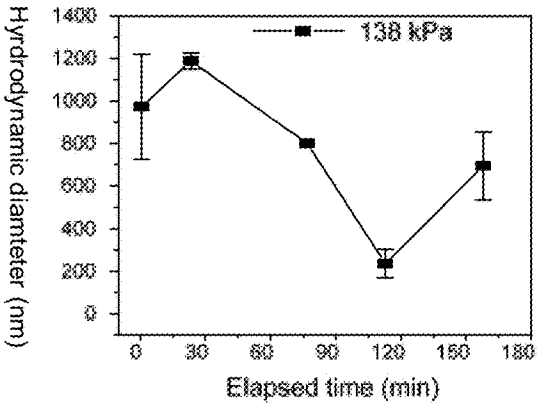
FIG. 5B
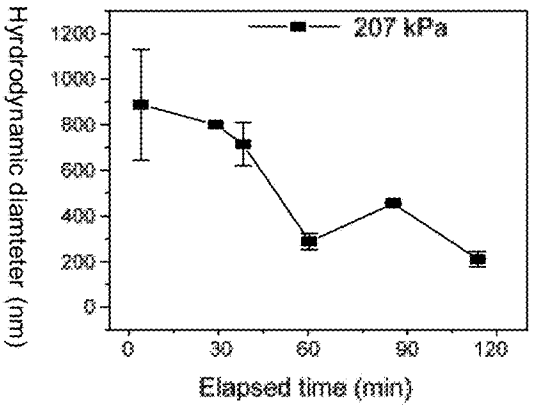
FIG. 5C
FIG. 5D
FIG. 5E
FIG. 5F

SYSTEM, DEVICE, AND METHOD TO MANUFACTURE NANOBUBBLES

CROSS-REFERENCE TO RELATED APPLICATION(S)

The present application claims priority to U.S. provisional application No. 62/560,948, filed Sep. 20, 2017, which is incorporated herein by reference.

FIELD OF THE DISCLOSURE

The present disclosure relates to systems, devices, and methods for manufacturing nanobubbles.

BACKGROUND

Nanobubbles have recently gained increased attention due to their unique physicochemical properties, and many potential applications, such as detergent-free cleaning processes, tertiary oil recovery, foam fractionation, mineral flotation, food processing, intracellular drug delivery, mineral processing, biomedical engineering, medical, and environmental applications (e.g., water aeration). (Hofmann, A., et al., Role of bubble size for the performance of continuous foam fractionation in stripping mode. Colloids and Surfaces A: Physicochemical and Engineering Aspects 2015, 473, 85-94; Oshita, S.; Liu, S. In Nanobubbles characteristics and its application to agriculture and foods, International Symposium on Agri-Foods for Health and Wealth, August, 2013; pp 5-8.) Several properties of nanobubbles include long residence times in the solutions, large specific areas, high gas internal pressure, charged surface, excellent stability against coalesces, collapse or burst, and the formation of bulk bubbles.

Nanobubbles are frequently generated in a solution by creating a cavitation through four common mechanisms: hydrodynamic, acoustic, particle, and optical type. Variations in the pressurized liquid flux, due to system geometry, cause the hydrodynamic cavitation. Conversely, the pressure variations in the acoustic cavitation are produced by passing the ultrasonic waves through a liquid. Optical cavitation is generated by passing high intensity (laser) light photons in the liquid. However, passing other elementary particles in the liquid, e.g., a proton in bubbles chamber, is referred to as particle cavitation. Hydrodynamic and acoustic cavitation may cause changes in the chemical and physical properties of the liquid; but, particle and optic cavitation do not cause any of these changes. Hydrodynamic cavitation is safer and more energy efficient than acoustic cavitation. Therefore, hydrodynamic cavitation is the most common usable type to generate micro nanobubbles.

Some distinctive designs of microbubbles generators include: swirl flow type, aura jet, cavitation nozzle, venturi type, original hydrodynamic reaction mixer, and depressurization-recirculation method. (Ushikubo, F. Y., et al., Evidence of the existence and the stability of nano-bubbles in water. Colloids and Surfaces A: Physicochemical and Engineering Aspects 2010, 361, 31-37; Serizawa, A., et al., In Laminarization of micro-bubble containing milky bubbly flow in a pipe, The 3rd European-Japanese Two-phase Flow Group Meeting, Certosa di Pontignano, 2003; Yano, H.; Sakai, A., System and method for generating nanobubbles, U.S. Patent Application Publication No. 2014/0191425) For example, a high-speed swirl flow first dissolves the gas into the liquid by compressing air flow in the liquid, then releases the mixed compressed flow through a nozzle to create nanobubbles by cavitation. Alternatively, the pressure variations in the acoustic cavitation are produced by passing the ultrasonic waves into a liquid. In the depressurization-recirculation method, the gas dissolution in the liquid is increased at high pressure between 0.25-0.27 MPa that causes supersaturation, and then the mixed gas water solution is decompressed to atmosphere pressure causing the nucleation of micro nanobubbles, which are released through a nozzle. The micro nanobubbles are recirculated to break down the gas through the water vortex.

Some innovative methods have been used to generate nanobubbles, including: (1) ultra-sonication was used on a palladium electrode to produce nanobubbles with a mean diameter of 300-500 nm; (2) Oeffinger and Wheatley proved that ultra-sonication of a surfactant mixture with regular purging of octa-fluoropropane gas could produce nanobubbles with a mean diameter of 400-700 nm (Oeffinger, B. E.; Wheatley, M. A., Development and characterization of a nano-scale contrast agent. Ultrasonics 2004, 42, 343-347); (3) nanobubbles was generated through two steps. First, the air was injected into the solution inside a steel vessel for 25 minutes to reach a supersaturation status at an internal gauge pressure of 455 kPa. Second, the air-saturated solution was depressurized through the needle valve with 2 mm internal diameter at a speed flow of 0.1 L $min^{-1}$. The generated nanobubbles diameters were between 200 nm to 720 nm (Calgaroto, S., et al., On the nanobubbles interfacial properties and future applications in flotation. Minerals Engineering 2014, 60, 33-40); and (4) Sang-Ryul Ryu injected a gas inside a bamboo filter to generate nanobubbles. (Sang-Ryul, R., Method and apparatus for generating nano-bubbles in liquid, U.S. Pat. No. 8,794,604)

Recently, the use of ceramic membranes as bubbling diffusers to generate ultra-small bubbles has gained attention. It has been widely investigated in several applications, including advanced oxidation processes in water and wastewater treatment, landfill leachate treatment, and activated sludge treatment. The use of micro-pores ceramic diffuser was also investigated at different flow rates 1, 2, and 3 $L \cdot m^{-1}$. The generated bubbles were in millimeters scale with the smallest bubble size of 0.51 mm. The narrow bubbles distribution was at a low flow rate. The greatest frequency of the smallest bubble size occurred at the lowest flowrate. (Siswanto, A., et al., In Investigation of Bubble Size Distributions in Oscillatory Flow at Various Flow Rates, The University of Sheffield Engineering Symposium Conference Proceedings Vol. 1, Sheffield: 2014)

The manufacture of nanobubbles using a ceramic membrane presents a challenge which must be addressed.

SUMMARY

Systems, devices, and methods for manufacturing nanobubbles are provided herein.

One aspect of the present disclosure relates to a system for manufacturing nanobubbles. In one embodiment, the system includes a medium, wherein in the medium is a liquid medium or a semi-liquid medium. A device is immersed in the medium. The device includes a ceramic membrane having a first surface and an opposing second surface, and pores extending through the membrane from the first surface to the second surface, and a hydrophobic porous coating layer disposed on the first surface of the membrane. The system includes a gas source for providing a gas to the medium. The gas enters pores on the second surface of the membrane and exits the device in the form of nanobubbles.

Another aspect of the present disclosure relates to a device for manufacturing nanobubbles. In one embodiment, the device includes a ceramic membrane having a first surface and an opposing second surface, and pores extending therethrough between the first surface and the second surface. The second surface of the ceramic membrane defines a plenum having a first opening and an opposing second opening. The plenum is fluidly coupled to the pores at the second surface of the membrane. A hydrophobic porous coating layer is disposed on the first surface of the membrane.

Yet another aspect of the present disclosure relates to a method of manufacturing nanobubbles. In one embodiment, the method includes flowing a gas into a medium containing a device immersed therein. The device includes a ceramic membrane having a first surface and an opposing second surface, and pores extending therethrough between the first surface and the second surface. The second surface of the ceramic membrane defines a plenum having a first opening and an opposing second opening. The plenum is fluidly coupled to the pores at the second surface of the membrane. A hydrophobic porous coating layer is disposed on the first surface of the membrane. The method includes generating nanobubbles of the gas by flowing the gas through the first and second openings into the plenum, and subsequently through the pores of the membrane at the second surface, wherein the gas exits the device as nanobubbles.

BRIEF DESCRIPTION OF THE DRAWINGS

FIGS. 5A-F are plots of hydrodynamic diameter of nanobubbles generated over a range of pressures.

DETAILED DESCRIPTION

The following detailed description of systems and methods for producing nanobubbles designs refers to the accompanying drawings that illustrate exemplary embodiments consistent with these systems and methods. Other embodiments are possible, and modifications may be made to the embodiments within the spirit and scope of the methods and systems presented herein. Therefore, the following detailed description is not meant to limit the devices described herein. Rather, the scope of these devices is defined by the appended claims.

Figure 1A:
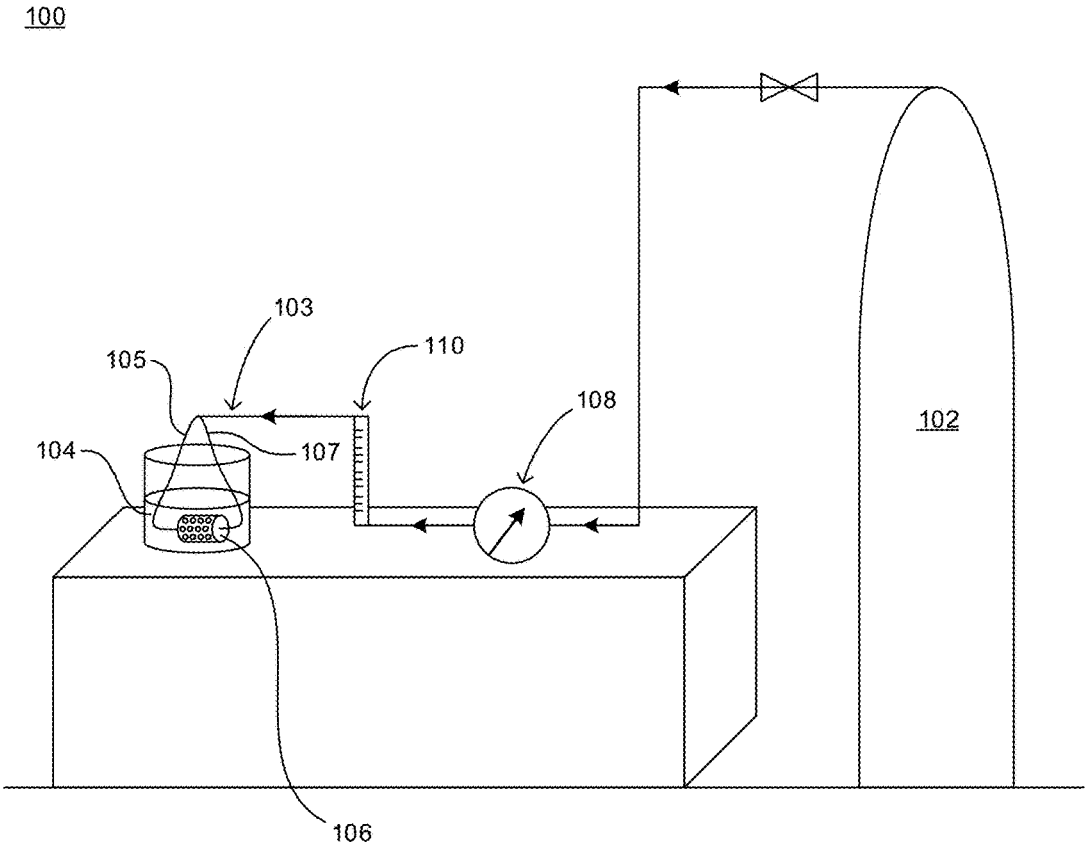
FIG. 1A is a schematic view of a nanobubbles generator system in accordance with an embodiment of the disclosure.

FIG. 1 is a schematic view of a nanobubbles generation system 100 in accordance with an embodiment of the disclosure. The system 100 includes a gas source 102 for providing a gas. The gas source can be a pressured gas tank, cylinders, or other pressurized gas sources such as gas compressors. The gas is supplied from the gas source 102 to a medium 104. The medium 104 can be a liquid or semi-liquid. Exemplary liquids include water, ethanol, and isopropyl alcohol. Exemplary semi-liquids include oil/water mixtures, surfactant/water mixtures, and solid particle suspension. The surface tension and viscosity of the liquid medium may affect the size of nanobubbles formed. For example, the viscosity of the liquid medium may range from 0.5 to 1.3 mPa·s. At a lower viscosity, the produced nanobubbles could be smaller in size. Immersed within the medium 104 is a device 106. The device 106 is described in more detail below with respect to FIGS. 2A-2C. In operation, the gas from the gas source enters the medium 104 proximate the location of the device 106. The gas enters a pore of the device at a first side and exit the pore of the device at a second side in the form of a nanobubble. In the embodiment illustrated in FIG. 1, the gas is provided from the gas source through a conduit 103. The conduit 103 is divided into two conduits 105, 107 prior to entering the medium 104. One conduit 105 provides the gas to a first end of the device 106 and the other conduit 107 provides gas to the second end of the device 106. The conduit 103 is one possible embodiment. In other embodiments, a second conduit and second gas source (not illustrated in FIG. 1A) can be used to supply a gas to the second end of the device 106.

The system 100 can includes subsystems and components to measure and control process variables, such as flowrate and gas pressure, as necessary to achieve effective generation of nanobubbles. For instance, the system 100 can include a gas pressure regulator 108 to control the pressure of the gas supplied from the gas source 102. The system 100 can include a gas flow meter 110 to control the flow rate of the gas entering the medium 104. The system can include one or more sensors or other detection means (not illustrated in FIG. 1A) to monitor process conditions, such as temperature of the medium, flow rate and/or pressure of the injection gas. The system 100 can include a controller (not illustrated in FIG. 1) to communicate with the one or more sensors and adjust one or more process parameters. For instance, the controller could monitor and control all components and processes of the system, such as temperature of the medium, gas pressure, gas flow rate, and the like.

Figure 1B:
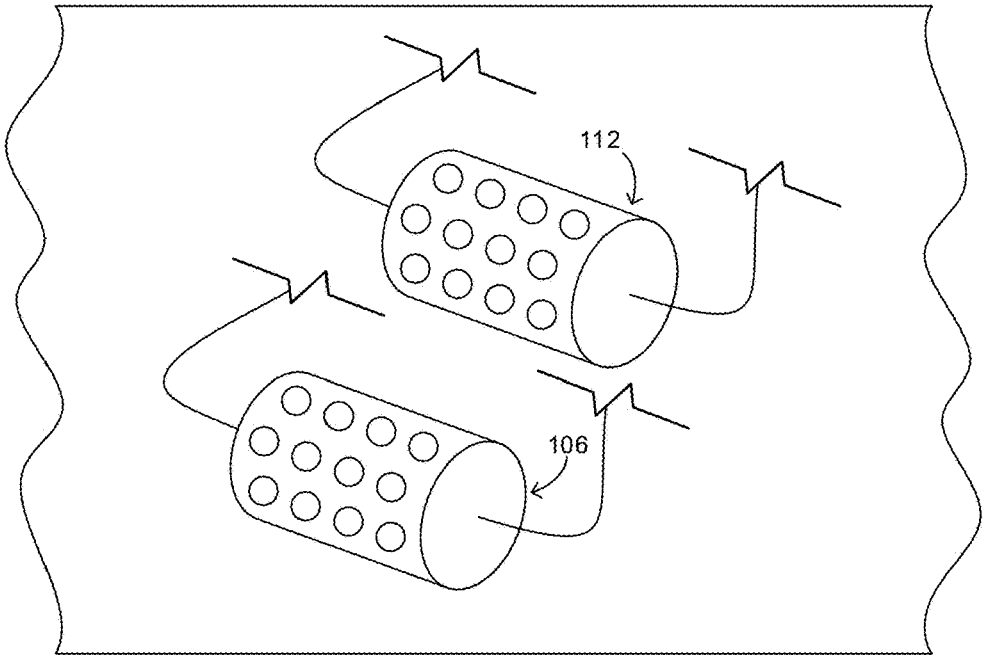
FIG. 1B is a partial schematic view of a nanobubbles generator system in accordance with an embodiment of the disclosure.

FIG. 1B is a schematic view of an alternative embodiment that can be used in the system 100. A rate of generation of nanobubbles can at least partially depend on the number of pores available in the device. In some embodiments, multiple devices may be used to increase the rate of generation of nanobubbles. For example, in FIG. 1B, the pressurized gas is injected simultaneously to the device 106 and a second device 112 to produce nanobubbles.

Figure 2A:
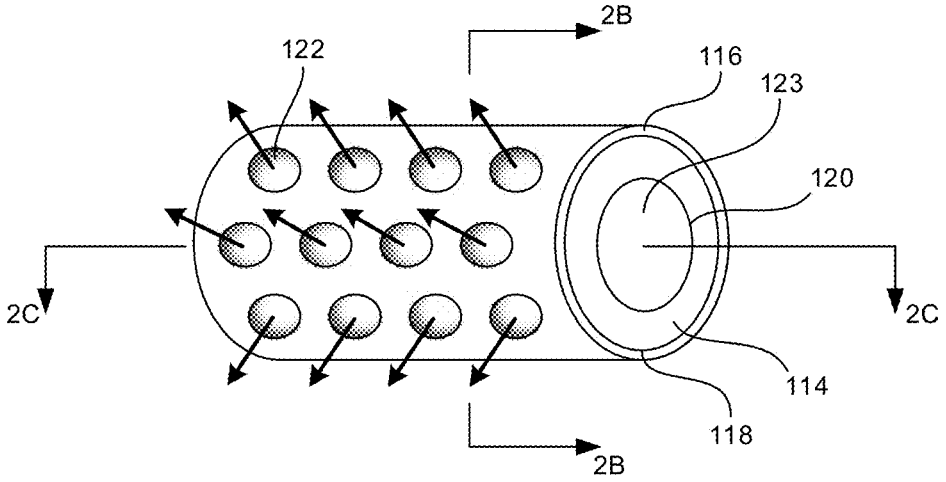
FIG. 2A is a perspective view of a device for generating nanobubbles in accordance with an embodiment of the disclosure.
Figure 2B:
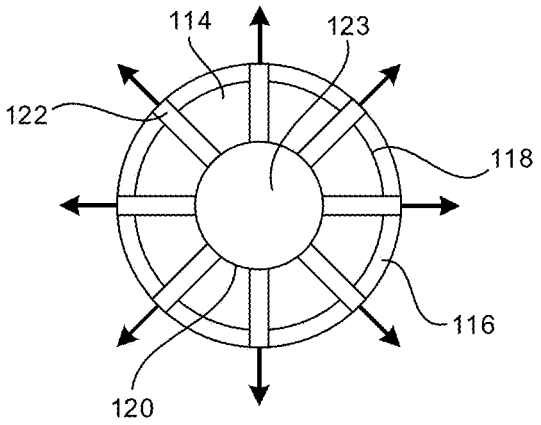
FIG. 2B is a cross section view of the device in FIG. 2A.
Figure 2C:
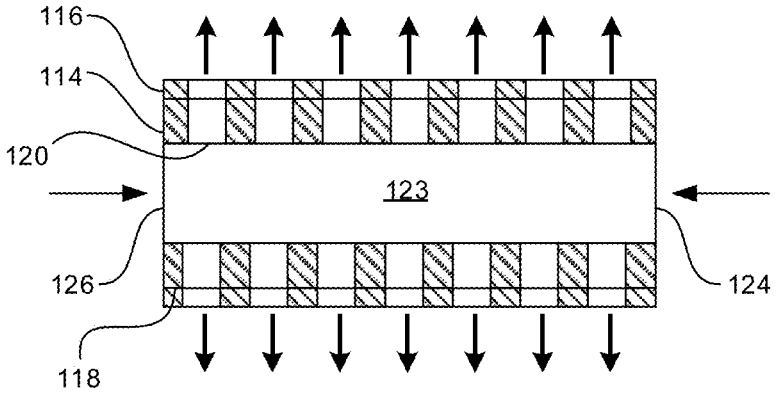
FIG. 2C is a cross section view of the device in FIG. 2A.

FIGS. 2A-2C are perspective and cross section views of the device 106 for generating nanobubbles in accordance with an embodiment of the disclosure. The device 106 includes a ceramic membrane 114 and a hydrophobic porous coating layer 116. The ceramic membrane 114 includes a first surface 118 and an opposing second surface 120. Pores 122 extend through the membrane 114 from the first surface 118 to the second surface 120. The second surface 120 defines a plenum 123. The plenum 123 has a first opening 124 and an opposing second opening 126. The plenum is fluidly coupled to the pores 122 of the membrane 114 at the second surface 120. In operation, the gas from the gas source 102 enters the plenum 123 at the first and second openings 124 and 126, and travels through the pores 122 from the second surface 120 to the first surface 118 of the membrane 114 and emerges from the membrane 114 as nanobubbles.

The ceramic membrane 114 can be made of a ceramic material that is inert to the gas and the medium 104. Exemplary ceramic materials can include $Al_2O_3$, $TiO_2$, $Si_3N_4$, and stainless steel. The ceramic membrane may be impermeable to the gas except through the pores 122. The pores 122 can have a diameter of about 100 nanometers (nm) or less. In an embodiment, the pores 122 can range from about 20 to about 500 nm. A thickness of the membrane can range from about 5 mm to about 1 cm. The diameter of the plenum can range from about 2 cm to about 10 cm. The width of the membrane as defined between the first opening 124 and the second opening 126 ranges from about 5 cm to about 20 cm. Thickness, diameter and width can be adjusted as necessary to produce nanobubbles on a scale of the desired application.

Figure 3A:
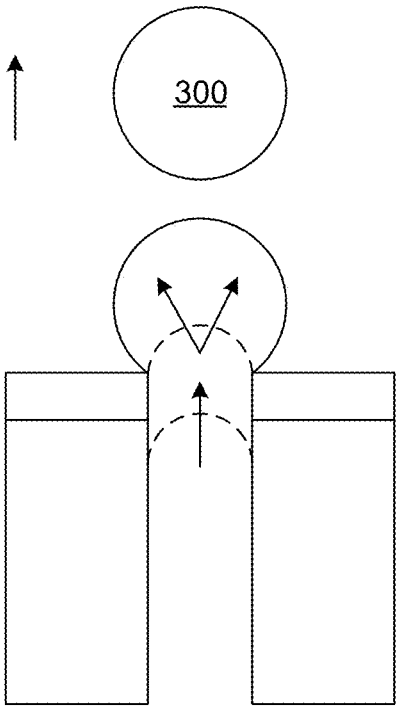
FIG. 3A is a schematic view of nanobubble formation as a gas moves through a pore.
Figure 3B:
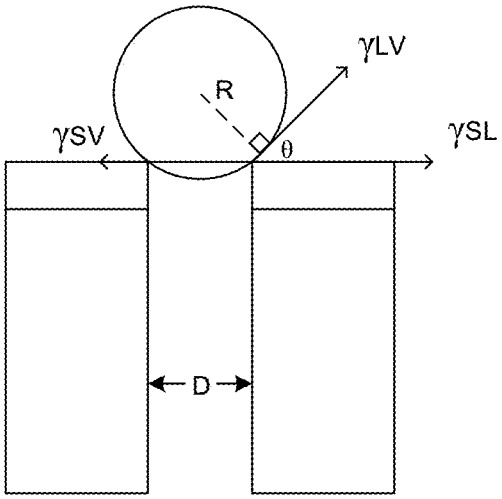
FIG. 3B is schematic view of factors that influence formation of a nanobubble.

The first surface 118 of the membrane 114 is coated the hydrophobic coating layer 116. The hydrophobic coating layer 116 is used to adjust hydrophobicity of the first surface 118 to control the size of the nanobubbles being produced. FIGS. 3A-3B are schematic views of nanobubble formation as a gas traverses a pore of the membrane 113. FIG. 3A illustrates an embodiment of a bubble formation process through a pore of the membrane 114. As illustrated in FIG. 3A, the gas pushes against the medium as it exits the pore and a nanobubble 300 is formed.

FIG. 3B illustrates the influence of pore size and surface tension or hydrophobicity of ceramic membrane and liquid or gases, where nanobubbles are at a critical metastable state and ready to detach from the ceramic pore and rise up. At the interface of a solid (i.e., the hydrophobic coating layer 116), a liquid (i.e., the medium 104), a gas (i.e., the gas provided by the gas source 102), Young equation can be used to describe the relation of solid-vapor interfacial energy ($\gamma_{SV}$), the solid-liquid interfacial energy ($\gamma_{SL}$), the liquid-vapor interfacial energy ($\gamma_{LV}$) and the equilibrium contact angle ($\theta$):

$$\gamma_{SV}=\gamma_{SL}+\gamma_{LV}\cos\theta$$

From the geometry relation shown in FIG. 3B, the following equation can be derived to show the dependence of the size of nanobubbles on the pore size (D) and surface energy ($\theta$):

$$2R\cdot\sin\theta=D \text{ or } R=D/(2\cdot\sin\theta)$$

If the pore size (D) increases, the size of the bubble generated increases. If the surface becomes more hydrophobic (i.e., $\theta$ increases), then the size of the bubble decreases. The maximum bubble size that can be generated is equal to the pore size, when $\theta$ is close to 90° and $\sin\theta=1$. According to this analysis, adjusting the hydrophobicity of the surface by using the hydrophobic porous coating layer 116 can be used to achieve different sizes of nanobubbles. The hydrophobicity of the coating layer, as indicated by the value of $\theta$, may range from 60-150°. The nanobubble size is observed to decrease by about 50% or more, under the same injected gas pressure, in the presence of the hydrophobic coating layer. Shrinking membrane pore size alone does not appear to reduce nanobubble sizes.

Figure 4A:
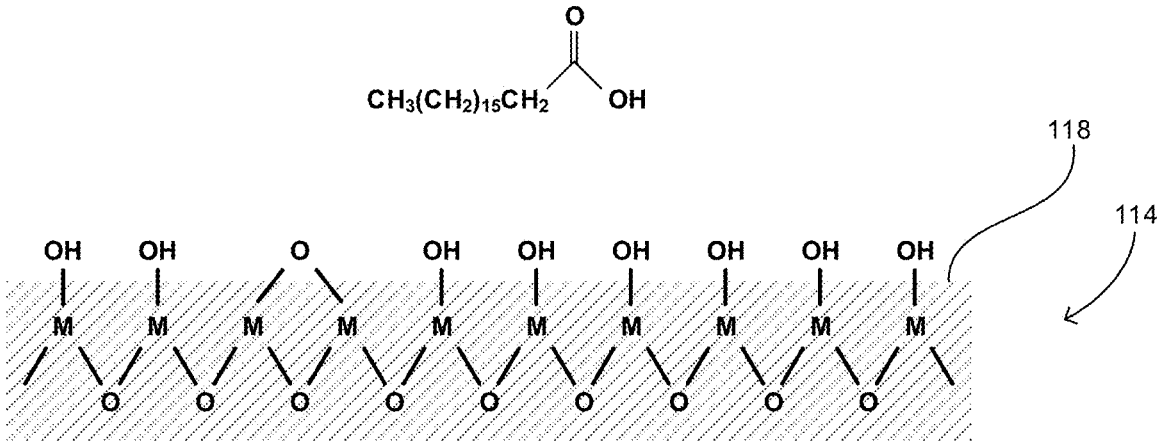
FIG. 4A is a schematic view of a surface of the ceramic membrane prior to application of a hydrophobic coating layer.
Figure 4B:
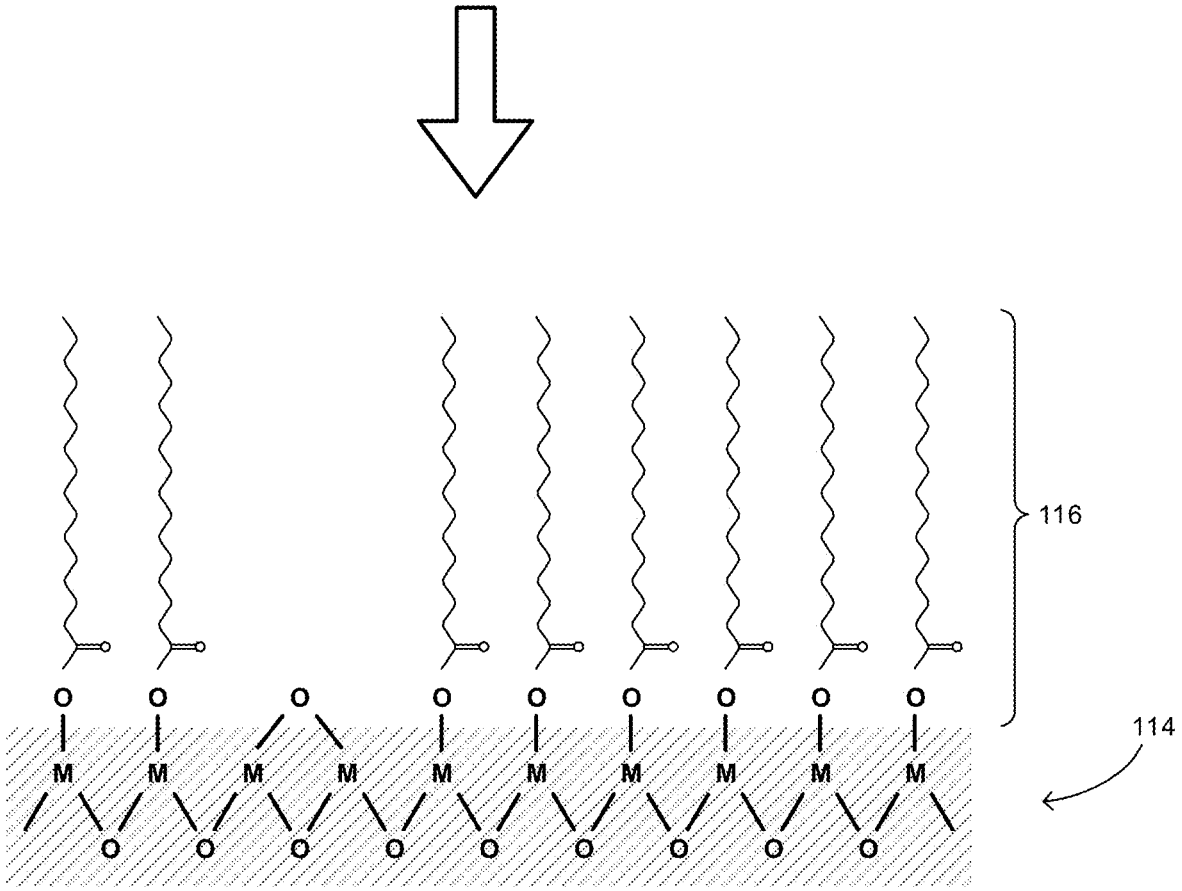
FIG. 4B is a schematic view of the surface in FIG. 4A with a hydrophobic coating layer.

FIGS. 4A-4B are schematic views which depict the stages of fabrication for the hydrophobic porous coating layer 116. A suitable hydrophobic molecule is selected to attach to the first surface of the membrane 114 to form the hydrophobic porous coating layer 116. The hydrophobic molecule can be a molecule having a saturated hydrocarbon chain, such as ranging from C5-C20. Exemplary hydrophobic molecules include stearic acid (illustrated in FIGS. 4A-4B), octadecanoic acid and silica coating.

One method to form the hydrophobic porous coating layer 116 is described herein. The membrane 114 can be cleaned to remove contaminants from the surfaces thereof. One exemplary cleaning process is sonication of the membrane in water or another medium that is inert to the membrane 114. Sonication may be performed for about 15 minutes, or a length of time sufficient to clean the surfaces of the membrane 114. After sonication, rigorous water cleanings of the surfaces can further be used if necessary. The plenum 122 is then isolated from exposure to the formation process, for example, by capping the first and second openings 124, 126 to prevent solution from entering the plenum 122. In one embodiment, rubber caps can be inserted into the openings 124, 126 to isolate the plenum 122. The membrane 114 is placed into a solution that includes the hydrophobic molecule. The solution can include a solvent, such as methanol or ethanol. The membrane 114 may be immersed in the solvent for about 24 hours, or an appropriate time to ensure coating with the hydrophobic molecule. The solution can be stirred while the membrane 114 is immersed to facilitate good dispersion of the hydrophobic molecule in the solution and chemisorption of the molecule to the first surface 118 of the membrane 114. Upon removal from the solution, the membrane can be rinsed up to several times with water and/or ethanol to remove excess molecules that didn't attach to the first surface 118. The membrane 114 can be dried at a suitable temperature, for example about 60° C. for about 24 hours.

One exemplary method to produce nanobubbles is described herein with reference to the system 100. The gas is injected into the medium 104 through the conduit 103 at a gas pressure sufficient to produce nanobubbles of a desired size. Exemplary gases may include, but are not limited to, high-purity air, oxygen, hydrogen, carbon dioxide, nitrogen and helium. In some embodiments, the gas is injected at a pressure ranging from 200-500 kPa. In one embodiment, the pressure is about 60 pounds per square inch (psi) or about 414 kilopascal (kPa). The pressure regulator can be monitored and adjusted to maintain the desired gas pressure. The flow rate of the gas in the conduit 103 can be controlled by adjusting the flow meter 110, which does not affect the nanobubble size in water. In one embodiment, the flow rate is about 0.024 $L \cdot min^{-1}$ $cm^{-2}$. The flow rate can be monitored and adjusted to maintain the desired flow rate as discussed herein. The gas leaves the conduits 105, 107 and enters the openings 124, 126, respectively of the plenum 123. From the plenum 123 the gas enters the pores 122 at the second surface 120 of the membrane 114. The gas exits the pores 122 as nanobubbles. In some embodiments, the size of the nanobubbles may range from about 100 nm to about 300 nm, following a normal size distribution. The size of the nanobubbles can be controlled by several factors as discussed herein, such as gas pressure, pore size of the membrane, hydrophobicity of the coating layer, and properties (e.g., surface tension and viscosity) of the medium. The produced nanobubbles in water suspension could be readily applied to any target system such as water, soil, or food through injection, spraying or immersion for water treatment, purification, remediation, pathogen mitigation, or agricultural applications.

EXAMPLE 1

Effect of Injection Gas Pressure on Nanobubble Size

Based on the above-mentioned generation method (e.g., using a tubular ceramic membrane of 100 nm pore size with a stearic acid coating), air nanobubbles (ANBs) were prepared in deionized water at injection air pressures ranging from 69 kPA to 414 kPA over periods of up to 120 minutes with results shown in FIG. 5. The hydrodynamic diameter of the ANBs measured by a dynamic light scattering instrument (Nano Z S, Malvern, UK) was unstable and fluctuating at injected air pressure lower than 40 psi (275 kPa), even after more than one hour of continuous air injection. The stability of the hydrodynamic diameter was improved at injected air pressures of 50 and 60 psi (345 kPa and 414 kPa), especially after at least 30 min of continuous air injection. The injected air pressures of 345 and 414 kPa resulted in a mean diameter of 350 and 340 nm respectively.

EXAMPLE 2

Influence of the Pores Size on Nanobubble Size

Figure 6A:
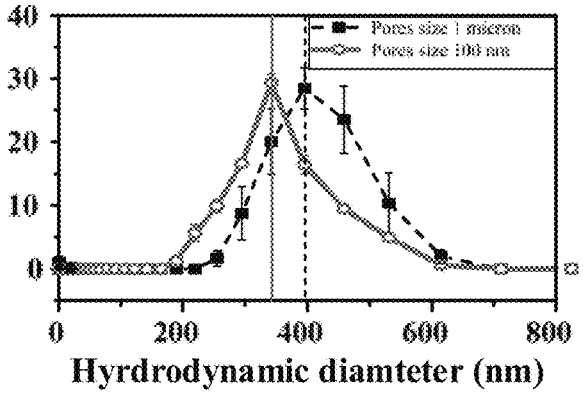
FIG. 6A is a plot of the frequency of nanobubble generation over a range of hydrodynamic diameter using a membrane having 100 nanometer and 1 micron pore sizes, respectively.
Figure 6B:
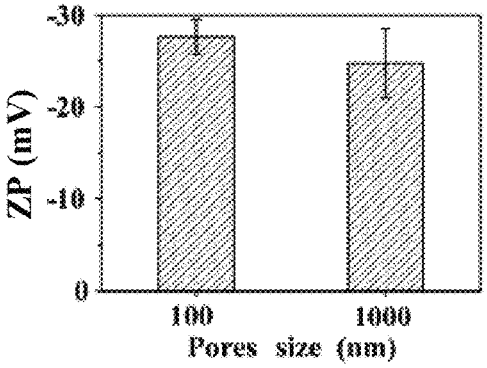
FIG. 6B is a plot of the zeta potential at the respective membrane pore sizes of 100-nm and 1-μm for the membranes of FIG. 6A.
Figure 6C:
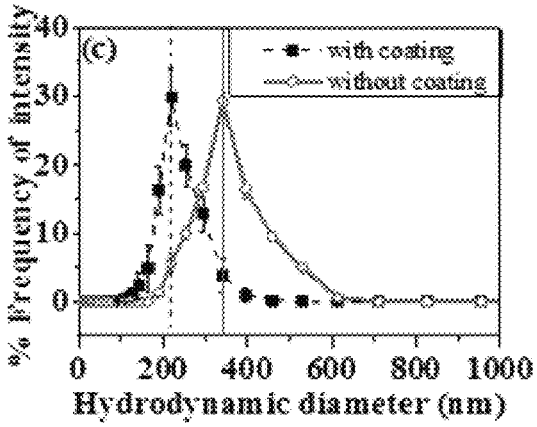
FIG. 6C is a plot of the frequency of nanobubble generation over a range of hydrodynamic diameter using a membrane having 100 nanometer pores with and without a coating.
Figure 6D:
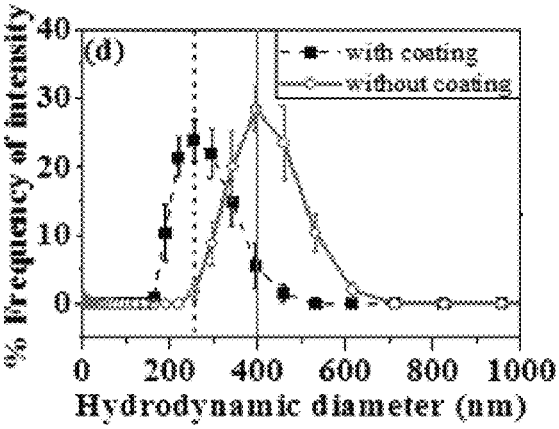
FIG. 6D is a plot of the frequency of nanobubble generation over a range of hydrodynamic diameter using a membrane having 1 micron pores with and without a coating.

Following the same generation method as described in this patent, FIG. 6A compares the impact of pore size of the membrane on nanobubble size distribution in water for the ceramic membranes of 100-nm and 1-μm pore sizes. FIG. 6B compares the zeta potential at the respective membrane pore sizes of 100-nm and 1-μm. A description of zeta potential can be found elsewhere. (Ahmed, Ahmed Khaled Abdella, et al. "Generation of nanobubbles by ceramic membrane filters: The dependence of bubble size and zeta potential on surface coating, pore size and injected gas pressure." Chemosphere 203 (2018): 327-335.) FIGS. 6C and 6D compare the impacts of the stearic acid surface coating on nanobubble size distribution in water for the ceramic membranes of 100-nm and 1-μm pore sizes, respectively. The coating decreases the mean hydrodynamic diameters, which is congruent with predicted effect of surface hydrophobicity. Hydrophobic surface was reported to enhance the surface bubble formation (Ryan and Hemmingsen, 1993; Maoming et al., 2010a), because during the formation of NBs, a high hydrophobic surface may radically suppress the bubble outward due to hydrophobic repulsion.

EXAMPLE 3

Enhanced Seed Germination and Vegetable Plant Growth by Nanobubble Irrigation The nanobubble water has demonstrated positive impacts seed germination and vegetable plants growth. Specifically, pure air, oxygen, nitrogen, and carbon dioxide nanobubbles in water were prepared using the same generation method as in Example 1 (e.g., using a tubular ceramic membrane of 100-nm pore size with a stearic acid coating). The water filled with different nanobubbles was used to irrigate plants of lettuce, carrot, fava bean, and tomato. The seeds in water containing NBs exhibited 6-25% higher germination rates. Especially, nitrogen NBs exhibited considerable effects in the seed germination, whereas air and carbon dioxide NBs did not significantly promote germination. The growth of stem length, diameter, leave numbers, and leave width were promoted by NBs (except air).

Figure 7A:
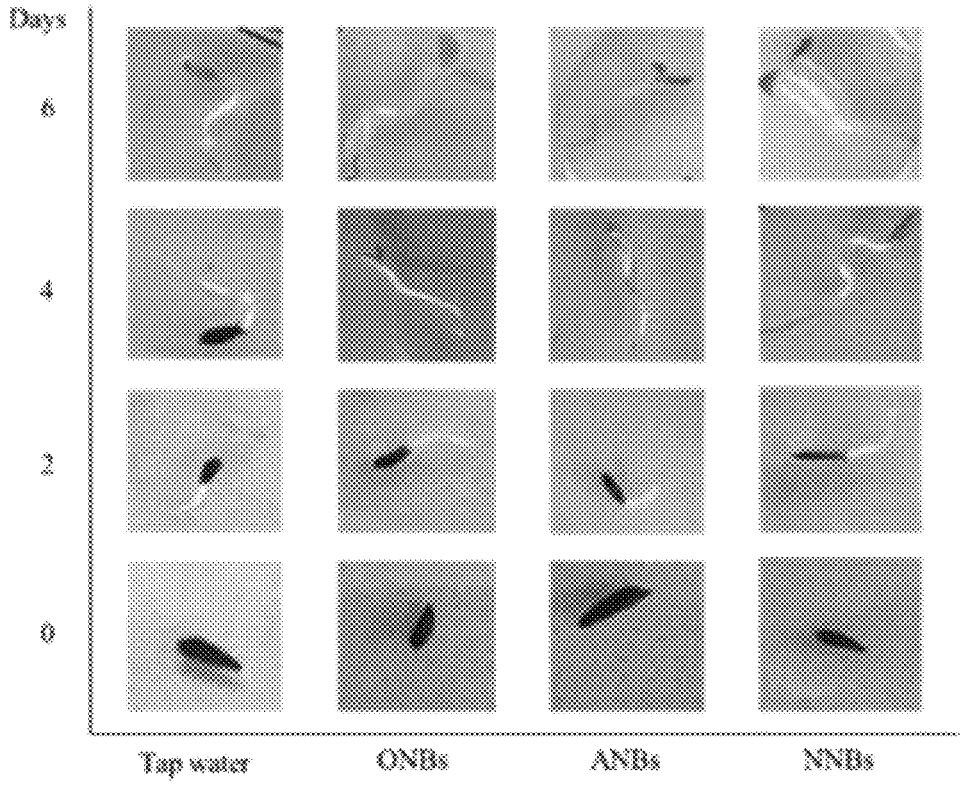
FIG. 7A depicts seed germination using several types of nanobubbles.
Figure 7B:
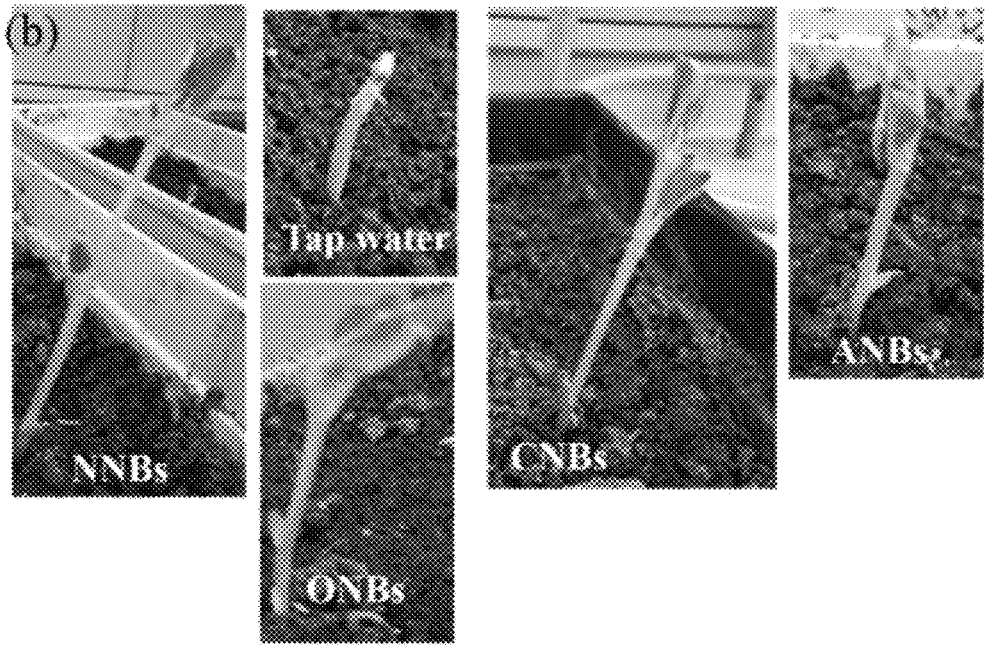
FIG. 7B depicts plant growth using several types of nanobubbles.
Figure 7C:
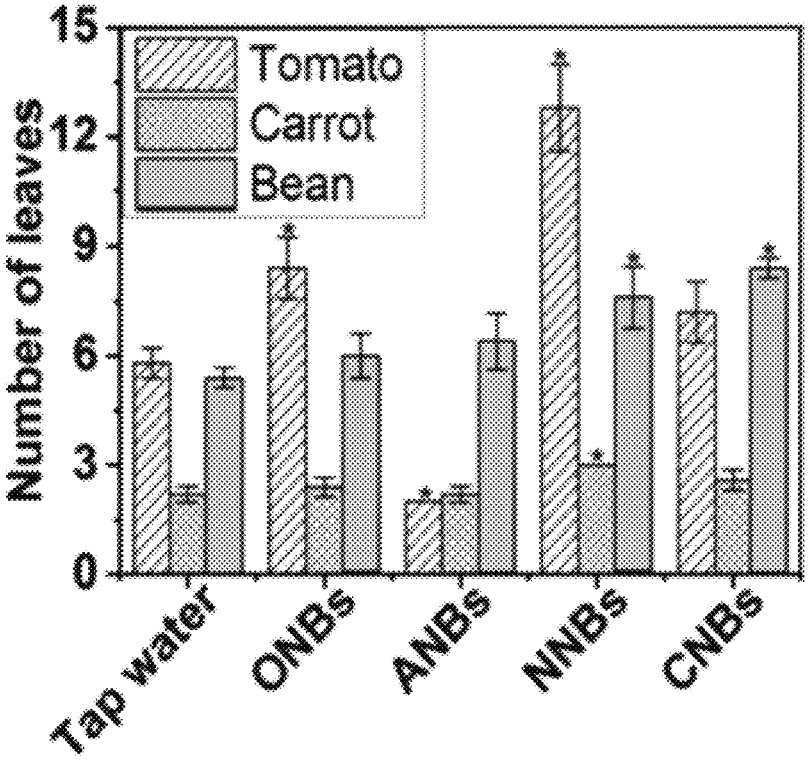
FIG. 7C depicts plant growth using several types of nanobubbles.
Figure 7D:
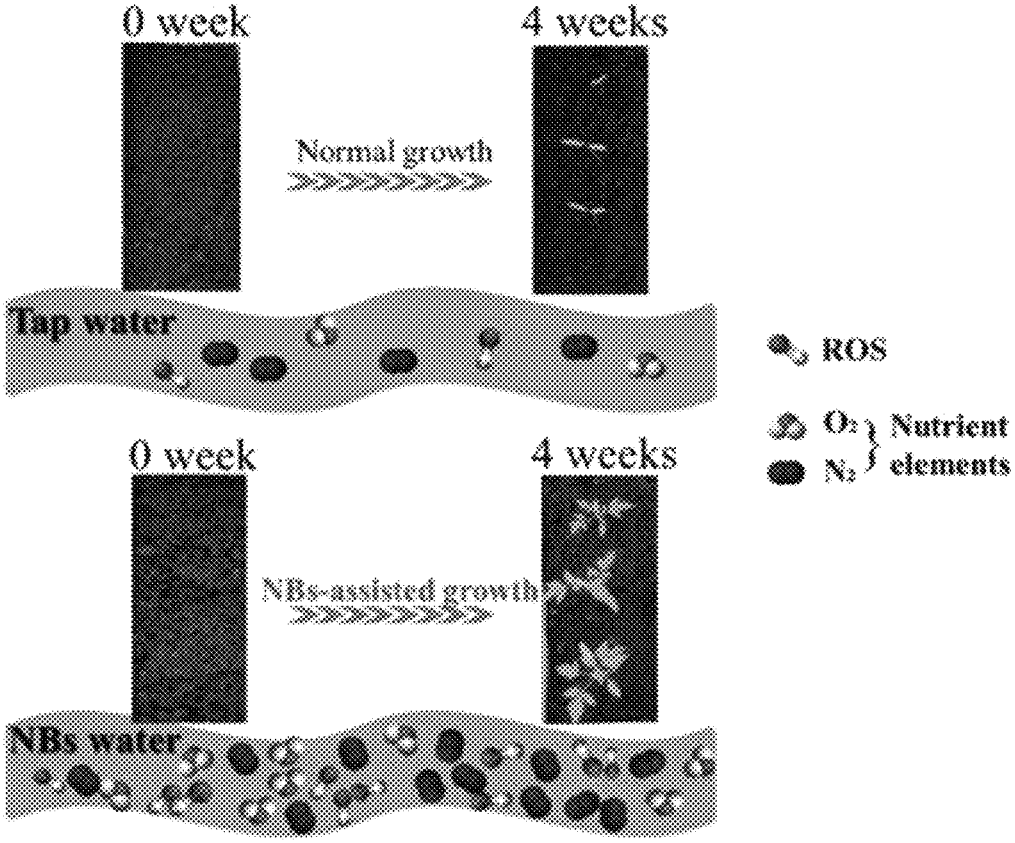
FIG. 7D is a schematic view of nanobubble assisted growth of plants.

FIG. 7A shows the hypocotyl growth process of lettuce under immersion into different NB waters and tap waters. Clearly, the promotion effects by NBs became evident on the 4th and 6th days of incubation. Seeds exposed to NBs had a higher germination rate and hypocotyl length than seeds treated with tap water. FIG. 7B shows that beans after one week of watering by four different NBs grew quite differently. NBs-treated beans grew faster with apparent leaves sprouting out of their buds, whereas the tap water-treated ones had no leaf sprout during the same initial growth period. FIG. 7C reveals nitrogen NBs promoted most plants (especially tomato) in terms of leave numbers. FIG. 7D illustrates that the promotion effect could primarily be ascribed to the generation of exogenous reactive oxygen species (ROS) by NBs and higher efficiency of nutrient fixation or utilization. Since ROS is one of the activation agents involved in cell wall loosening and cell elongation, the continuous supply of proper levels of ROS by NBs may sustain a long-lasting stimulation of living organisms and thus promotes plant growth. For nitrogen NBs, the considerable promotion effect on the germination rate may result from the effective delivery of nitrogen elements or other growth factors by NBs. FIG. 7A depicts photos hypocotyl growth process of lettuce seeds at different submersion days. FIG. 7B depicts growth of fava bean (Vicia faba) taken after the first week of incubation. FIG. 7C tabulates the influence of water type on number of leaves of tomato, carrot, and bean after 37 days. FIG. 7D depicts potential mechanisms of promotion effects of NBs on plants. (Ahmed, A. K. A.; Shi, X.; Hua, L.; Manzueta, L.; Qing, W.; Marhaba, T.; Zhang, W., Influences of Air, Oxygen, Nitrogen, and Carbon Dioxide Nanobubbles on Seed Germination and Plant Growth. Journal of Agricultural and Food Chemistry 2018, 66, 5117-5124, which is incorporated herein by reference in its entirety)

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A nanobubble generator system, consisting of:

a medium, wherein in the medium is a liquid medium or a semi-liquid medium; a device immersed in the medium, the device consisting of:

a ceramic membrane having a first surf ace and an opposing second surface, and a plurality of pores extending through the ceramic membrane from the first surf ace to the second surface; and a hydrophobic porous coating layer disposed on the first surface of the ceramic membrane, wherein the hydrophobic porous coating layer is non-metallic and selected from a group consisting of stearic acid, octadecanoic acid, and silica coating; and the pores of the ceramic membrane have a diameter ranging from about 20 nm to about 500 nm;

a linear plenum defined by the opposing second surface of the ceramic membrane, the plenum having a first opening and an opposite facing second opening, and the plenum fluidly coupled to the pores of the ceramic membrane at the second surface;

the first opening and the second opening are facing linearly opposite, and are both on a singular and same axis as each other; and a gas source for providing a pressurized gas to the medium via the pores, and a conduit disposed between the gas source and the ceramic membrane and the conduit having two outlets for providing the gas, wherein the gas enters the pores on the opposing second surface of the ceramic membrane and the gas enters the plenum bi-directionally from different and opposite facing directions on the singular and same axis of the first and the second openings, and the gas exits the hydrophobic porous coating layer in the form of a plurality of nanobubbles that have a controlled sized diameter, and the gas source creates an injection pressure at about 60 psi or higher, as indicated by a gas flow meter or a gas pressure regulator, to generate the plurality of nanobubbles having a controlled diameter ranging from about 100 nm to about 300 nm.

2. The system of claim 1, wherein the medium is selected from a group consisting of water, ethanol, ionic liquids, oil, and any combination thereof.

3. The system of claim 1, wherein the viscosity of the medium ranges from about 0.5 to about 1.3 mPa·s.

4. The system of claim 1, wherein the thickness of the ceramic membrane ranges from about 5 mm to about 1 cm; and the hydrophobic porous coating layer is used to control the size of the nanobubbles being produced.

5. The system of claim 1, wherein the hydrophobic porous coating layer has a hydrophobicity indicated by a value of θ ranging from about 60° to 150°, wherein the diameter size of the nanobubble is decreased by at least 50% as compared to the ceramic membrane without the hydrophobic porous coating exposed to the same injected gas pressure conditions.

6. The system of claim 1, wherein the two outlets are immersed in the medium, where one outlet provides gas to the first opening and the other outlet provides gas to the second opening.

7. The system of claim 1, wherein the gas flow meter or the gas pressure regulator disposed between the gas source and the medium.

8. A method of making nanobubbles, comprising:

providing a nanobubble generator system consisting of a medium, wherein in the medium is a liquid medium or a semi-liquid medium; a device immersed in the medium, the device consisting of:

a ceramic membrane having a first surf ace and an opposing second surface, and a plurality of pores extending through the ceramic membrane from the first surface to the second surface; and a hydrophobic porous coating layer disposed on the first surf ace of the ceramic membrane, wherein the hydrophobic porous coating layer is non-metallic and selected from a group consisting of stearic acid, octadecanoic acid, and silica coating; and the pores of the ceramic membrane have a diameter ranging from about 20 nm to about 500 nm;

a linear plenum defined by the opposing second surface of the ceramic membrane, the plenum having a first opening and an opposite facing second opening, and the plenum fluidly coupled to the pores of the ceramic membrane at the second surface;

the first opening and the second opening are facing linearly opposite, and are both on a singular and same axis as each other; and a gas source for providing a pressurized gas to the medium via the pores, and a conduit disposed between the gas source and the ceramic membrane and the conduit having two outlets for providing the gas, wherein the gas enters the pores on the opposing second surface of the ceramic membrane and the gas enters the plenum bi-directionally from different and opposite facing directions on the singular and same axis of the first and the second openings, and the gas exits the hydrophobic porous coating layer in the form of a plurality of nanobubbles that have a controlled sized diameter, and the gas source creates an injection pressure at about 60 psi or higher, as indicated by a gas flow meter or a gas pressure regulator, to generate the plurality of nanobubbles having a controlled diameter ranging from about 1 00 nm to about 300 nm;

flowing the gas into the medium containing the device immersed therein; and generating the plurality of nanobubbles in the medium by injecting the gas through the first and second openings into the plenum, and subsequently through the pores of the ceramic membrane at the second surface, wherein the gas exits the device at the pores in a form of the plurality of nanobubbles.

9. The method of claim 8, further comprises adjusting a pressure at which the gas is injected into the medium to control the size of the nanobubbles generated.

10. The method of claim 8, wherein the medium includes at least one of water, ethanol, an electrolyte, or oil.

11. The method of claim 8, wherein the viscosity of the medium ranges from about 0.5 to about 1.3 mPa·s.

* * * * *